US008455777B2

(12) United States Patent
Enoch

(10) Patent No.: US 8,455,777 B2
(45) Date of Patent: Jun. 4, 2013

(54) ELECTRICAL SWITCH

(75) Inventor: Claus Enoch, Koge (DK)

(73) Assignee: MEC A/S, Ballerup (DK)

( * ) Notice: Subject to any disclaimer, the term of this patent is extended or adjusted under 35 U.S.C. 154(b) by 141 days.

(21) Appl. No.: 13/127,948

(22) PCT Filed: Nov. 5, 2009

(86) PCT No.: PCT/EP2009/064709

§ 371 (c)(1),
(2), (4) Date: Jun. 28, 2011

(87) PCT Pub. No.: WO2010/052280

PCT Pub. Date: May 14, 2010

(65) Prior Publication Data

US 2011/0253519 A1 Oct. 20, 2011

Related U.S. Application Data

(60) Provisional application No. 61/111,866, filed on Nov. 6, 2008.

(30) Foreign Application Priority Data

Nov. 6, 2008 (EP) ..... 08168508

(51) Int. Cl.
*H01H 13/70* (2006.01)

(52) U.S. Cl.
USPC ..... 200/345

(58) Field of Classification Search
USPC ..... 200/345, 341
See application file for complete search history.

(56) References Cited

U.S. PATENT DOCUMENTS

| | | | | |
|---|---|---|---|---|
| 4,096,368 | A | 6/1978 | Grebner | |
| 4,166,935 | A | 9/1979 | Norby | |
| 4,431,879 | A | 2/1984 | Fujita et al. | |
| 6,969,815 | B1 * | 11/2005 | Lu | 200/345 |
| 7,030,331 | B2 * | 4/2006 | Sasaki | 200/341 |
| 7,138,593 | B2 * | 11/2006 | Toyoda | 200/345 |
| 7,180,025 | B2 * | 2/2007 | Kuwana et al. | 200/520 |
| 7,462,796 | B1 * | 12/2008 | Chai | 200/341 |
| 2003/0150703 | A1 * | 8/2003 | Tsau | 200/345 |
| 2004/0094396 | A1 * | 5/2004 | Lee et al. | 200/345 |
| 2008/0023312 | A1 * | 1/2008 | Chin | 200/345 |

FOREIGN PATENT DOCUMENTS

| | | | |
|---|---|---|---|
| DE | 4137890 | A | 5/1993 |
| FR | 2859818 | A1 | 9/2003 |

* cited by examiner

*Primary Examiner* — Briggitte R Hammond
(74) *Attorney, Agent, or Firm* — Muncy, Geissler, Olds & Lowe, PLLC

(57) ABSTRACT

An electrical switch adapted to be engaged by a first and/or a second activation button by means of which a user may operate the electrical switch. The electrical switch comprises an activation element which defines first and second retaining surfaces for engagement with the first and the second activation button, respectively.

15 Claims, 6 Drawing Sheets

B-B ( 4 : 1 )

ELECTRICAL SWITCH

FIELD OF THE INVENTION

The present invention relates to an electrical switch with an activation element which is movable between a switched and a non-switched position. Moreover the present invention relates to one or more activation buttons each of which is adapted to be attached to the activation element. Furthermore, the present invention relates to the combination of an electrical switch and an activation button. Finally, the present invention relates to a kit of an electrical switch and an activation button.

BACKGROUND OF THE INVENTION

In today's electronic devices electrical switches are a common used element, thus, it is desired from a manufacturers and a costumer's point of view that the switches are as inexpensive and as versatile as possible.

It is an object of an embodiment of the present invention to provide a system by means of which a few elements may be combined into a plurality of different switching elements.

Furthermore, it is an object of an embodiment of the present invention to provide an electrical switch which is adapted to be engaged by at least two different switch buttons.

Moreover, it is an object of an embodiment of the present invention to provide an electrical switch in which a light emitting element remains in the same position independent on the position of an activation button of the switch.

DESCRIPTION OF THE INVENTION

In a FIRST aspect the present invention relates to an electrical switch adapted to be engaged by a first and a second activation button by means of which a user may operate the electrical switch, the electrical switch comprising:

- a housing;
- at least one set of conductors, each set of conductors comprising a first conductor and a second conductor; and
- an activation element which is movable between:
  - a switched position in which the conductors are electrically connected, and
  - a non-switched position in which the conductors are not electrically connected,
- wherein an outer surface of the activation element defines:
- a set of first retaining surfaces adapted to retain the first activation button in relation to the activation element by engagement between the set of first retaining surfaces and a corresponding set of first mating surfaces defined by the first activation button, and
- a set of second retaining surfaces adapted to retain the second activation button in relation to the activation element by engagement between the set of second retaining surfaces and a corresponding set of second mating surfaces defined by the second activation button.

One advantage of the present invention is that a plurality of different activation buttons may be attached to the activation element. Due the provision of a first and a second retaining surface, two different surfaces may be provided for engagement with the mating surfaces (which are provided on the activation buttons). One result is that a plurality of different buttons may be provided.

The electrical switch may be adapted to be mounted on a Printed Circuit Board (PCB) by means of any known method such as by soldering. The electrical conductors of the device may be accessible from an outer surface of the electrical switch such that they may be fastened and electrically connected to a PCB. The conductors may comprise a metal material which may comprise tin such as Sn100 or tinbronze (CuNi).

The first and the second activation button may be of different shape. The cross-sectional shape of at least one of the activation buttons may be circular, oval, elliptical or polygonal such as triangular, quadrangular, etc. The activation button may comprise a transparent material. Said cross-section may define a plane which is parallel to the upper surface of the electrical switch e.g. the upper surface of the activation element.

The buttons may comprise a plastic material such as PPS (Polyphenylenesulfide). Alternatively, or as a supplement, the buttons may be reinforced with fibre glass or Kevlar.

The housing may comprise one or more parts. In one embodiment, the housing comprises an upper part and a lower part which are fastened to each other. In one embodiment, the upper part and the lower part are permanently fastened to each other by means of welding or gluing. By permanently fastened is meant that the two elements cannot be separated from each other without damaging one of the two parts or the material (e.g. glue) used to fasten the two elements to each other. In one embodiment, the upper part and the lower part are detachably fastened to each other e.g. by means of a snap lock. The housing may comprise the same materials as are described above in relation to the buttons.

The activation element may comprise any of the materials described in relation to the housing. The activation element is moveable between: a switched position in which the conductors are electrically connected, and a non-switched position in which the conductors are not electrically connected. In one embodiment, this movement is a linear movement e.g. into and out of the housing. In one embodiment, the movement causes the activation element to move along a normal of the surface onto which the electrical switch is fastened. In another embodiment, the movement is transverse to said normal e.g. parallel to the surface on to which the electrical switch is fastened. In one embodiment, the movement is a rotational movement e.g. such that the activation element and the activation button are rotated about a normal of the surface onto which the electrical device is fastened. In the alternative, the activation element is rotated about a line extending parallel to the surface onto which the electrical switch is fastened.

In order to allow two different kinds of activation buttons to be fastened to the activation element, an outer surface of the activation element defines a set of first retaining surfaces and a set of second retaining surfaces. In one embodiment, the activation element comprises more than two sets of retaining surfaces. Accordingly, the activation element may comprise a set of third retaining surfaces or a set of fourth retaining surfaces etc. It will be appreciated that the higher the number of retaining surfaces is, the larger is also the number of different kinds of buttons which may be fastened/attached to the activation element. Although this document is described in relation to two sets of retaining surfaces, it will be appreciated that any number of retaining surfaces may be provided and that the scope of protection covers any number of sets.

In one embodiment, the term "a set" shall be understood as at least one retaining surface. In another embodiment, the term "a set" shall be understood as at least two retaining surfaces. Accordingly, a set of retaining surfaces may comprise one, two, three, four, five etc. retaining surfaces.

Unless otherwise stated, terms such as vertical, horizontal, lateral, upwards, downwards, lower, upper, side etc., refer to the electrical switch in a position wherein it orientated such that the activation element defines the uppermost part of the device. However, it will be appreciated that the electrical switch, in use, may be orientated in any other way.

The first retaining surfaces and the second retaining surfaces may be provided at different radial, translational or circumferential positions. In one embodiment, the first retaining surface and the second retaining are provided at different vertical positions. In the latter embodiment, the length of the radially extending members which define the mating surfaces may be different. As an example, the set for first retaining surfaces may be positioned above the set of second retaining surfaces. Accordingly, in the latter example, the distance from the first set of retaining surfaces to the upper surface of the activation element is shorter than the distance from the second set of retaining surfaces to the same upper surface. Moreover, the first translationally extending members defined by the first activation button may be shorter than the second translationally extending members as the latter must be designed to extend from the upper surface of the activation element to the set of second retaining surfaces.

Alternatively, or as a supplement, the distance from the centre of the activation element to outer surface of the first activation element may be different than the corresponding distance from the centre of the activation element to the outer surface of the second activation element.

Alternatively, or as a supplement, the circumferential extent of the each of the first retaining surfaces may be different than the circumferential extent of each of the second retaining surfaces. In one embodiment, the first retaining surfaces have a larger circumferential extend than the second retaining surfaces. In another embodiment, it is the other way around.

In one embodiment, the first retaining surfaces are spaced apart circumferentially. In the latter embodiment, a second retaining surface may be provided in the spaces defined between the first retaining surfaces.

The first and second retaining surfaces may be arranged such with respect to each other that the first activation button cannot be retained in relation to the activation element by engagement between the first mating surfaces and the second retaining surfaces. When the latter situation is the case, the first activation button can only be retained to the activation element by engagement between the first mating surfaces and the first retaining surfaces.

Moreover, the first and second retaining surfaces may be arranged such with respect to each other that the second activation button cannot be retained in relation to the activation element by engagement between the second mating surfaces and the first retaining surfaces. When the latter situation is the case, the second activation button can only be retained to the activation element by engagement between the second mating surfaces and the second retaining surfaces.

The first and the second retaining surfaces may define any shape. In one embodiment, the first and/or the second retaining surfaces defines planar surfaces. In the latter embodiment, the retaining surfaces may be arranged so as to define a polygonal cross-section such as a hexagonal or an octagonal shape.

In another embodiment, the first retaining surfaces of the outer surface define arcs of a circle having a first radius and the second retaining surfaces of the outer surface define arcs of a circle having a second radius. The radiuses may be identical or different. Thus, the first radius may be larger than the second radius, or vice versa.

In one embodiment, the radiuses of the first retaining surfaces are not identical. Accordingly, one of the first retaining surfaces may have a larger radius than another of the first retaining surface. The same may be the case with the second retaining surfaces.

Either or both of the first and the second activation button (s) may comprise translationally extending members. Each of said members may define the associated mating surface. Accordingly, the first activation button may comprise translationally extending engagement members each of which may define one of the first mating surfaces. Additionally, the second activation button may comprise translationally extending engagement members each of which may define one of the second mating surfaces.

The activation element may define radially extending protrusions which defines the first retaining surfaces. In the latter case, the second retaining surfaces may be defined in the spaces defined between the radially extending protrusions, whereby, the translationally extending engagement members are positioned in spaces defined between the radially extending protrusions when the second activation button is attached to the activation element.

One or more of the activation buttons may be solid such that it does not define any cavities. Alternatively, or as a supplement, at least one of the first and second activation buttons may define a cavity with an opening. The opening may face the activation element when the activation button is attached to the activation element. In one embodiment, the opening defines a plane which coincides with a plane defined by the upper surface of the activation element.

In one embodiment, the activation element and one or more of the activation buttons are designed such that the activation element extends into the cavity of said one or more activation buttons, when the button is fastened to the activation element.

The electrical switch may comprise a light emitting element. In one embodiment, the light emitting element is arranged to emit light into that one of the activation buttons which is attached to the activation element. In the latter embodiment, the activation element may be transparent. The activation button may form a waveguide i.e. be capable of conducting visible light. Accordingly, the light emitted into the activation button may be visible from an outer surface of the activation button. The waveguide may be made from any of the materials known in optical fibre technology such as glass.

In one embodiment, the light emitting element may form part of the activation element e.g. by defining an outer (upper) surface of the activation element. In the latter embodiment, the light emitting element may be supplied with electrical energy when the activation element is depressed as the electrical conductors of the light emitting element is thus brought into contact with the one of the sets of conductors.

When the light emitting element forms part of the activation element, the light emitting element moves when the activation element moves. In the alternative, the light emitting element may remain in the same horizontal and/or vertical and/or rotational position relative to the housing irrespective of the position of the activation element. Accordingly, if the activation element is depressed, moved, rotated etc., the light emitting element remains in the same position.

As an example, the activation element may be adapted to be moved vertically in order to be changed between its switched and non-switched position. In this example the light emitting element may be provided such that it moves inside the cavity defined in the activation button, i.e. upon depression of the activation button, the light emitting element is moved further into the light emitting element, relatively.

The latter example provides the advantage that the light emitting element may be arranged such with respect to the activation button that light may be emitted into the cavity of that one of the activation buttons which is attached to the activation element while at the same time allowing said activation button to move the activation element between its switched and non-switched position.

It will be appreciated that such an arrangement of a light emitting element eliminates any moving parts in the light emitting element and, thus, reduces the risk of breaking of any conductors of the light emitting element.

In a SECOND aspect, the present invention relates to an activation button according to the first aspect for use with the electrical switch according to the first aspect.

In a THIRD aspect the present invention relates to a kit comprising an activation button according to the first and/or second aspect and an electrical switch according to the first aspect.

In a FOURTH aspect the present invention relates to a combination of an activation button according to the first and/or second aspect and an electrical switch according to the first aspect.

It will be appreciated that the first, second, third, and fourth aspect of the invention may be combined in any way.

BRIEF DESCRIPTION OF THE FIGURES

The invention will now be described with reference to the figures in which.

DETAILED DESCRIPTION OF THE DRAWINGS

Figure 1:
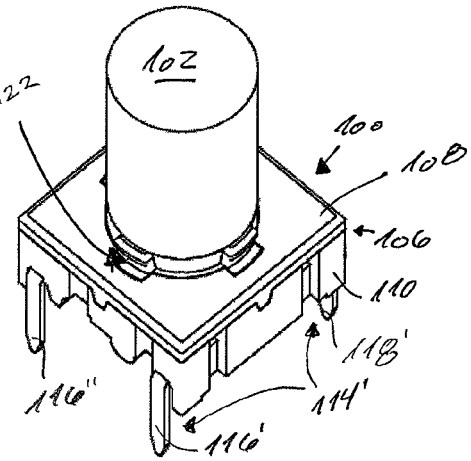
FIGS. 1 discloses an isometric view of the switch according to the invention with an embodiment of the second activation button, FIG. 2 discloses a side elevational view of the embodiment of the second activation button, FIGS. 3 and 4 disclose side elevational views of the electrical switch, FIG. 5 disclose a top plan view view of the electrical switch, FIG. 6 discloses a top plan view view of the electrical switch and the second activation button, FIG. 7 discloses a cross-sectional view corresponding to the section "B" in FIG. 4, FIG. 8 discloses a cross-sectional view corresponding to the circle "C" in FIG. 7, FIGS. 9-13 disclose isometric, top plan and elevational views of the switch according to the invention with an embodiment of the first activation button, FIG. 14 discloses a cross-sectional view corresponding to the section "F" in FIG. 11, FIG. 15 discloses a cross-sectional view corresponding to the circle "G" in FIG. 14, FIG. 16 discloses an exploded view of the switch according to the invention and the embodiment of the first activation button, FIGS. 17 and 19 disclose activation of the switch by means of the first activation button, and FIGS. 18 and 20 disclose cross sectional views corresponding to sections "C" and "B" in FIGS. 17 and 19.
Figure 2:
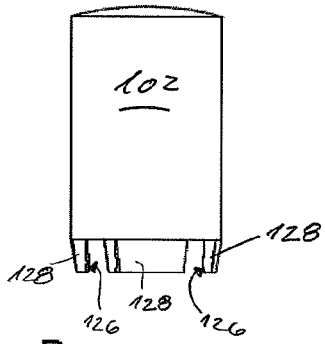
Figure 3:
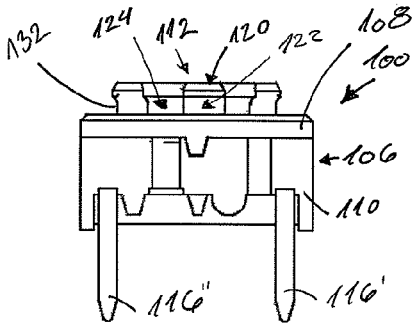
Figure 4:
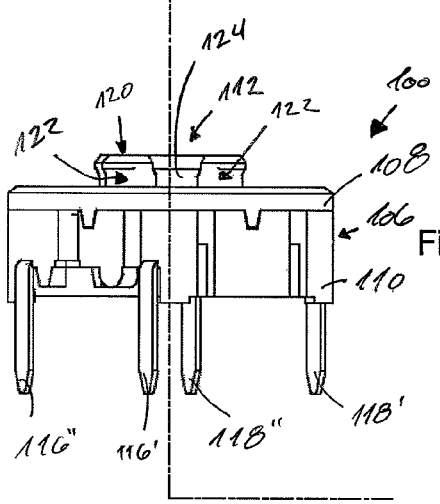
Figure 5:
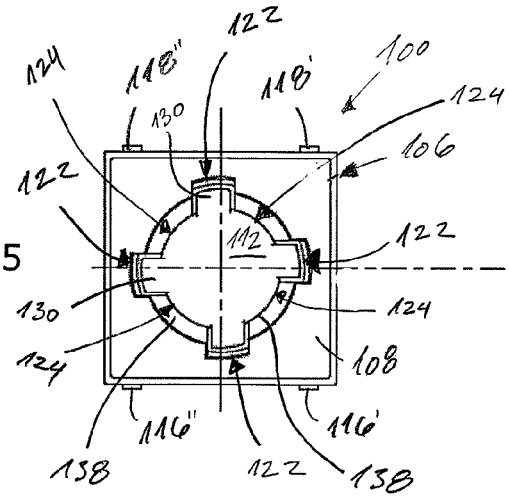
Figure 6:
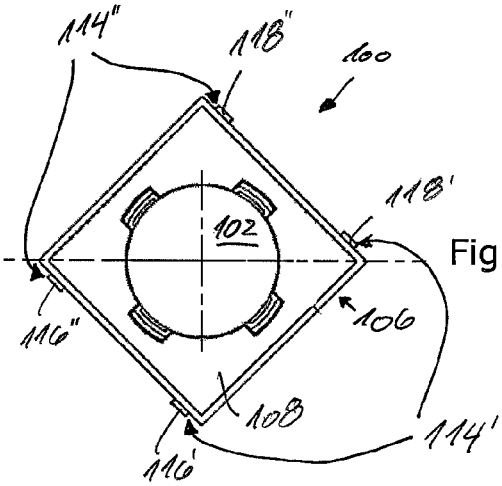
Figure 7:
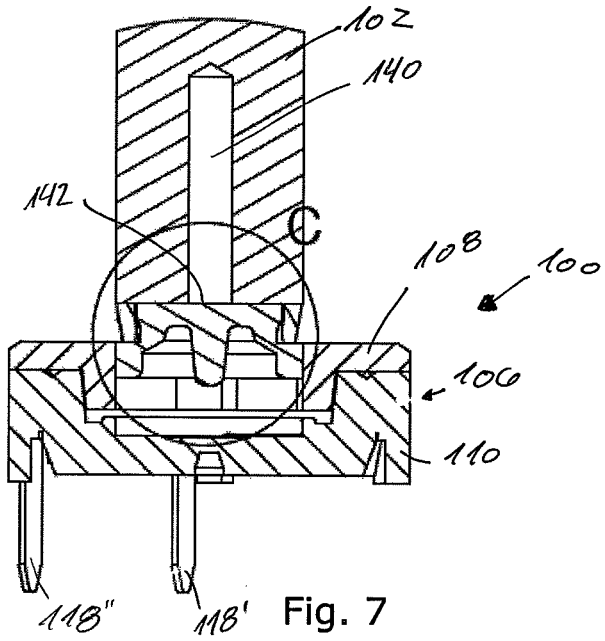
Figure 8:
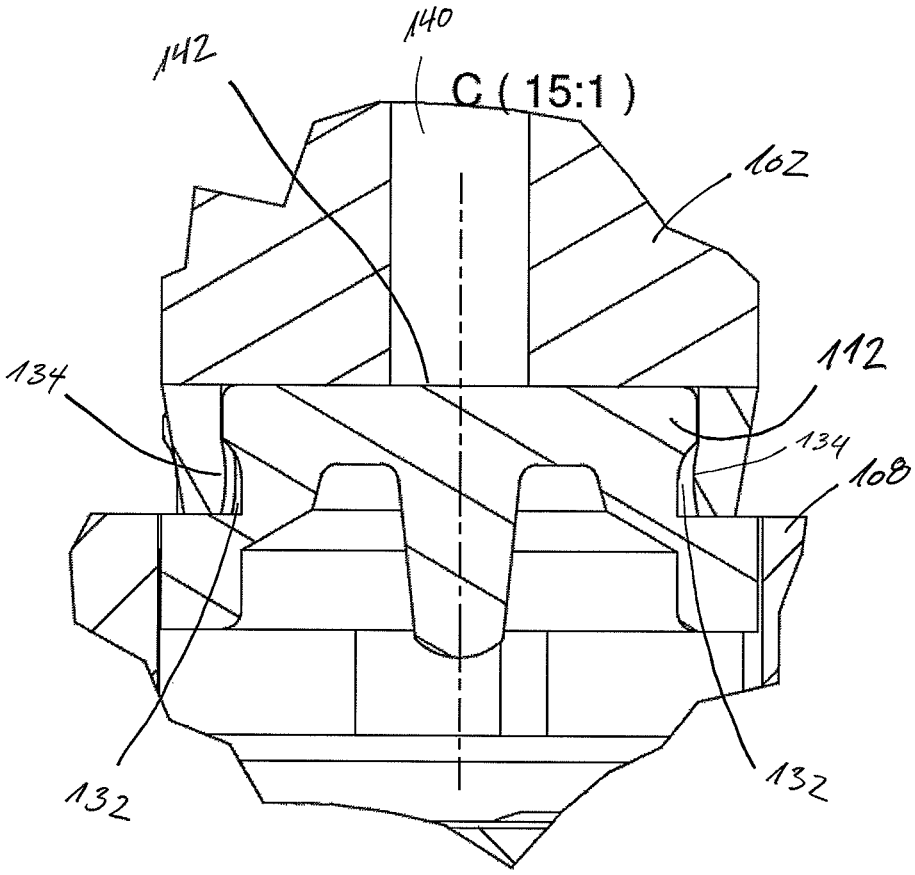
Figure 9:
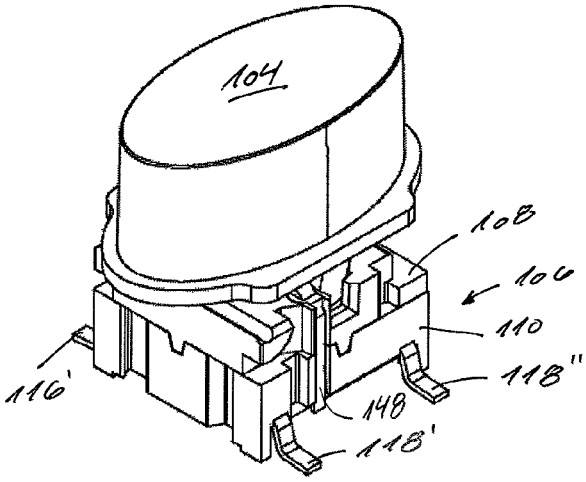
Figure 10:
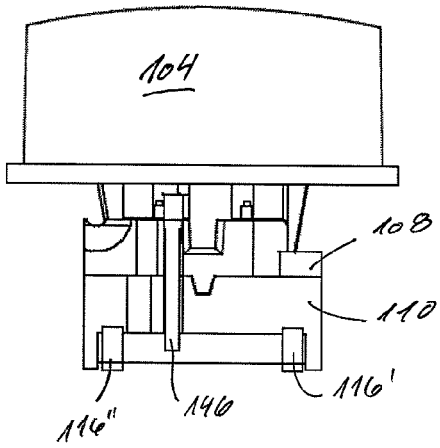
Figure 11:
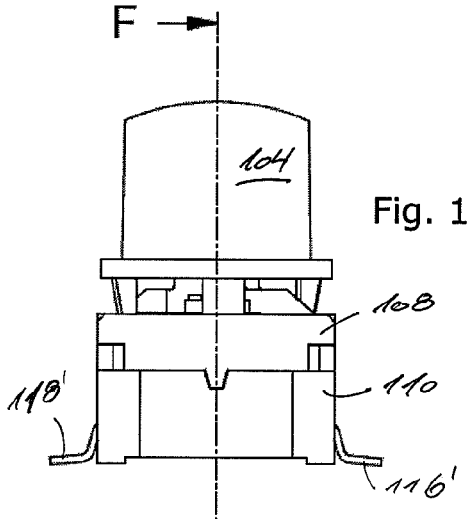
Figure 12:
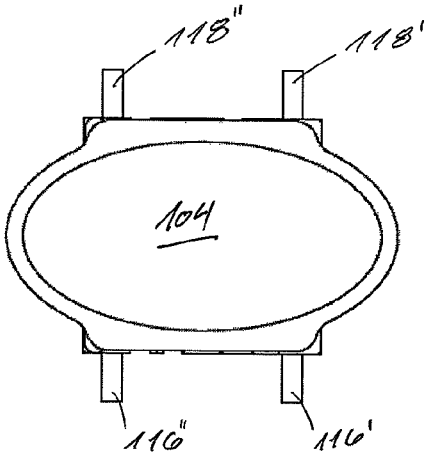
Figure 13:
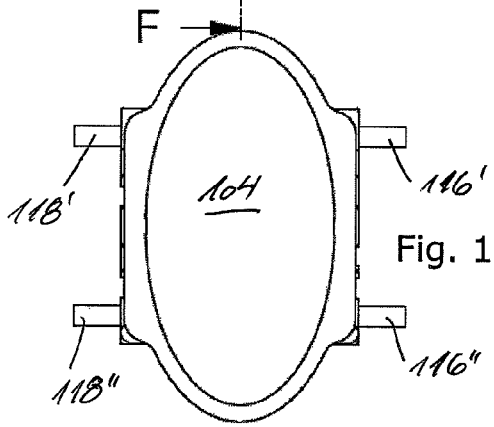
Figure 14:
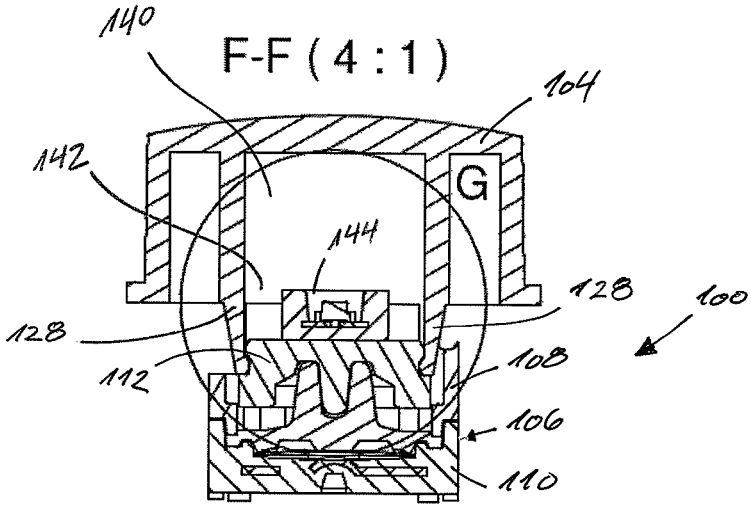
Figure 15:
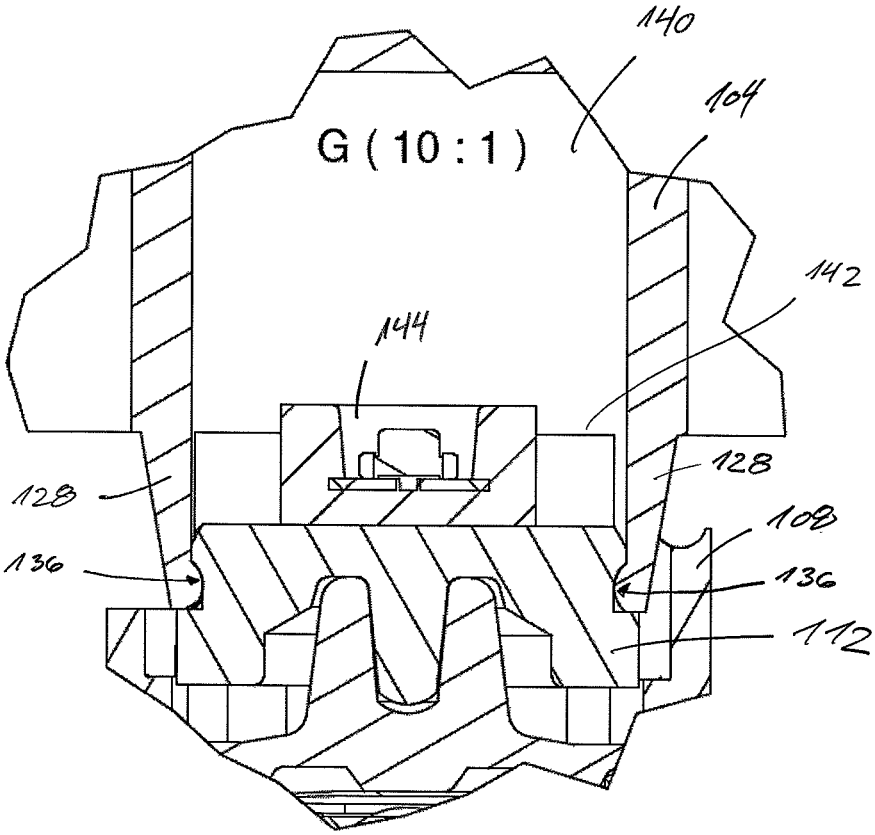

FIG. 1 discloses an isometric view of the electrical switch 100 which is engaged by the second activation button 102. The first activation button 104 is disclosed in FIGS. 9-20. FIG. 2 discloses a side elevational view of the second activation button 102. FIGS. 3-5 disclose the electrical switch 100 according to the invention. FIG. 6 discloses the electrical switch 100 and the second activation button 102.

The electrical switch 100 comprises a housing 106, with an upper part 108 and a lower part 110 which are fastened to each other. Examples of such fastening is gluing, welding, snap-locking, interference fitting. When the upper part 108 and the lower part 110 are fastened to each other, an activation element 112 is retained inside the housing 106. When retained inside the housing 106, the activation element 112 is movable between a switched position and a non-switched position. In the embodiment of the drawings, this movement of the activation element 112 is a vertical movement. This is illustrated in FIGS. 17-20 and explained in further detail in relation to these figures. In FIGS. 1-15 the activation element 112 is illustrated in its non-switched position.

The electrical switch 100 comprises at least one set of conductors 114',114". In the embodiments of the figures, the electrical switch 100 each comprise two sets of conductors 114',114". Each set of conductors 114',114" comprises a first conductor 116',116" and a second conductor 118',118". The conductors 116',116",118',118" are accessible from an outer surface of the electrical switch 100. In the embodiment of FIGS. 1-8, the conductors 116',116",118',118" are conventional conductors which during assembly are designed to be inserted into bores/cavities in the surface onto which the electrical switch 100 is assembled/fastened. It will be appreciated that such a surface may be a Printed Circuit Board (PCB). Moreover, it will be appreciated that some or all of the conductors may be suitable for SMD assembly (surface mounted device assembly) as is the case with the conductors of FIGS. 9-20.

When the activation element 112 is in its switched position, the conductors of each set of conductors 114',114' are electrically connected. Accordingly, the conductors 116',118' of the first set of conductors 114' are electrically connected. Additionally, the conductors 116",118" of the second set of conductors 114" are electrically connected.

The outer surface 120 of the activation element 112 defines first retaining surfaces 122 and second retaining surfaces 124. The first retaining surfaces 122 are adapted to retain the first activation button 104 in relation to the activation element 112. Similarly, the second retaining surfaces 124 are adapted to retain the second activation button 102 in relation to the activation element 112.

The second activation button 102 comprises a number (four in the figure) of second mating surfaces 126 defined on translationally extending members 128. In the embodiment of the figures, the translationally extending members 128 define fingers which extend downwards in the figures. The translationally extending members 128 are spaced apart whereby radially extending protrusions 130 of the activation element 112 may be received between the translationally extending members 128.

The second mating surfaces 126 are adapted and arranged to engage the corresponding second retaining surfaces 124 of the activation element. When the second mating surfaces 126 and the second retaining surfaces 124 engage each other, the second activation button 102 and the activation element 112 are fastened/retained in relation to each other. In order to provide such retaining, the second retaining surfaces 124 each defines an indentation 132 (see FIGS. 3 and 8) which is adapted to be engaged by a radially inward extending protrusion 134 of each of the translationally extending members 128 (see FIG. 8).

Similarly, first activation button 104 comprises a number (in FIGS. 9-20) of first mating surfaces 136 defined on its translationally extending members 128. The first mating surfaces 136 are adapted to engage the first retaining surfaces 122 of the activation element 112.

The first retaining surfaces 122 and the second retaining surfaces 124 each define arcs of a circle having a first radius and a second radius, respectively. It will be appreciated that the second radius is smaller than the first radius as the second retaining surfaces 124 are defined in the spaces 138 defined between the radially extending protrusions 130.

It will be appreciated that due to the differences in the diameters, the first retaining surfaces 122 can only be retained in relation to the first mating surfaces 136 and not in relation to the second mating surfaces 126.

Similarly, it will be appreciated that the second retaining surfaces 124 can only be retained in relation to the second mating surfaces 126 and not in relation to the first mating surfaces 136.

Due to the provision of a plurality of first and second retaining surfaces 122,124 along the circumference of the activation element 112, the first and second activation button 104,102 may be positioned in a plurality of different positions relative—rotationally—to the normal of the upper surface of the activation element 112.

The first and the second activation button 104,102 each define a cavity 140 with an opening 142 which faces the activation element 112 when the activation button 104,102 is attached to the activation element 112.

The second activation button 102 which is illustrated in FIGS. 9-20, defines a cavity 140 which is large enough to accommodate a light emitting element 144 having a first light emitter conductor 146 and a second light emitter conductor 148. Again the conductors 146,148 may be designed to be inserted into bores in a PCB or be suitable for SMD assembly. In one embodiment, the conductors are electrically connected to the remaining conductors 116,118 so as to be supplied with electrical power from said conductors 116,118.

The light emitting element 144 is arranged to emit light into the cavity 140 of that one of the activation buttons 104,102 which is fastened to the activation element 112.

The cavity 140, the activation element 112 and the light emitting element 144 are designed such that the light emitting element 144 remains in the same (vertical) position relative to the housing 106, irrespective of the position of the activation button 102,104 and the activation element 112. Accordingly, when the button 102,104 is moved downwards in the figures, the light emitting element 144 is moved further into the cavity 140, relatively.

Accordingly, the design provides the advantage that the light emitting element 144 is arranged such with respect to the activation button 104 that light may be emitted into the cavity 140 of that one of the activation buttons which is attached to the activation element, while at the same time allowing said activation button 104 to move the activation element 112 between its switched and non-switched position.

In order for the light emitted to be visible from an outer surface of the activation button 104,102, at least a part of the button 104,102 is transparent. It will be appreciated that the transparent material may be coloured such that when the light emitting element 144 emits light, the light changes colour to a predetermined colour.

Figure 16:
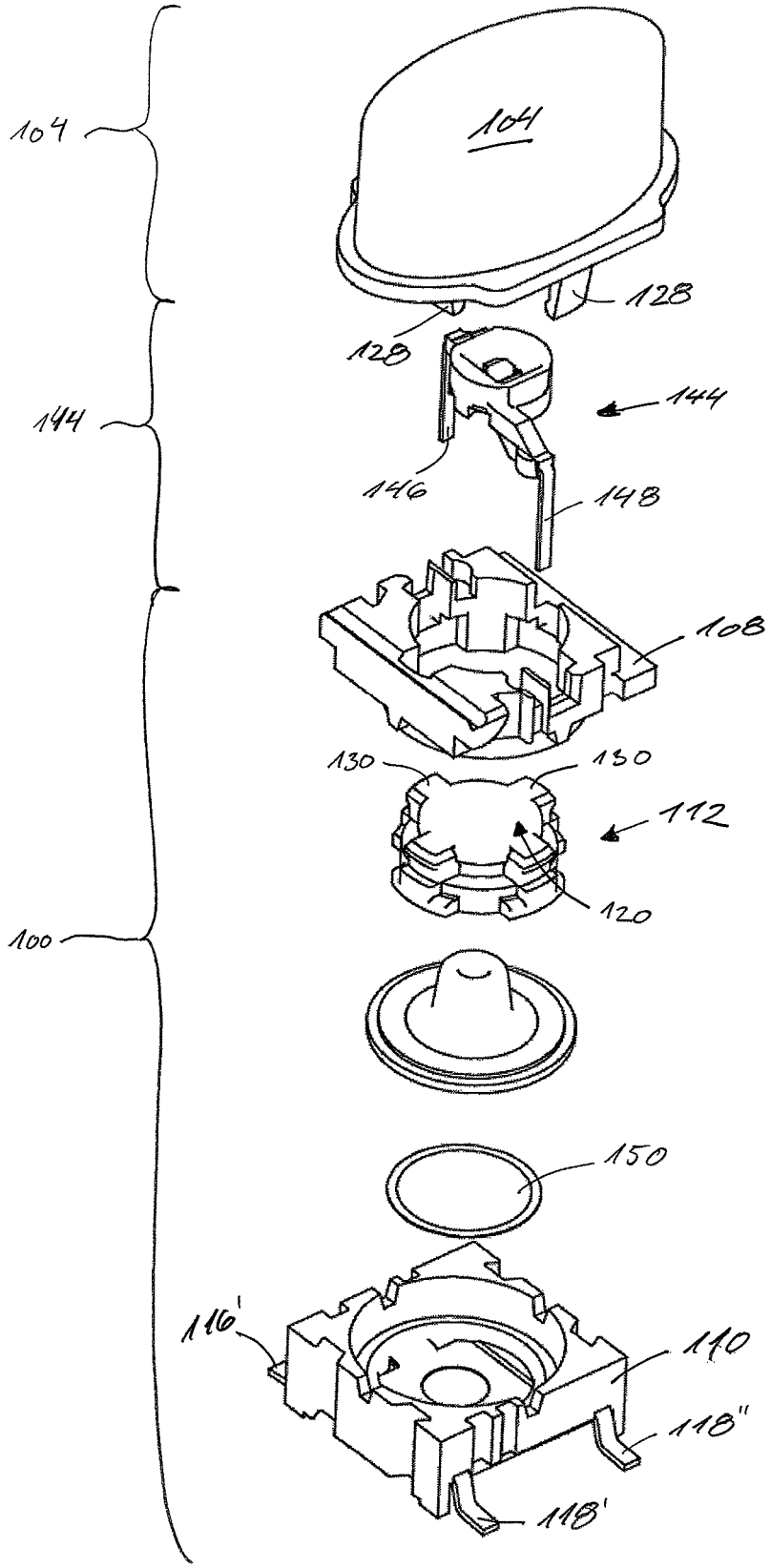

FIG. 16 discloses an exploded view of the electrical switch 100, the light emitting element 144 and the first activation button 104. The electrical switch 100 comprises a plurality of conductors 116',116",118',118" which all are electrically connected, when the activation element 112 is in its switched position. A connector element 150 is provided which causes all the conductors 116',116",118',118" to be electrically connected when the connector element 150 is depressed which is the case when the actuation element 112 is in its switched position.

Figure 17:
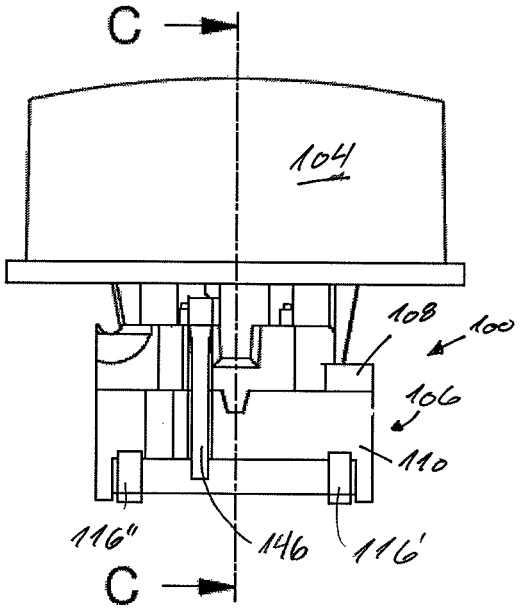
Figure 18:
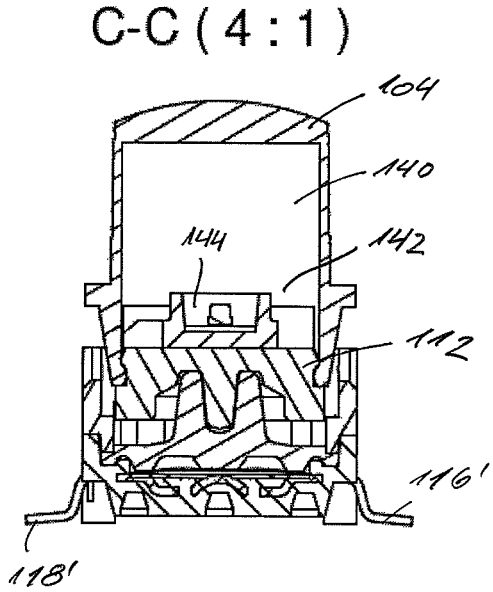
Figure 19:
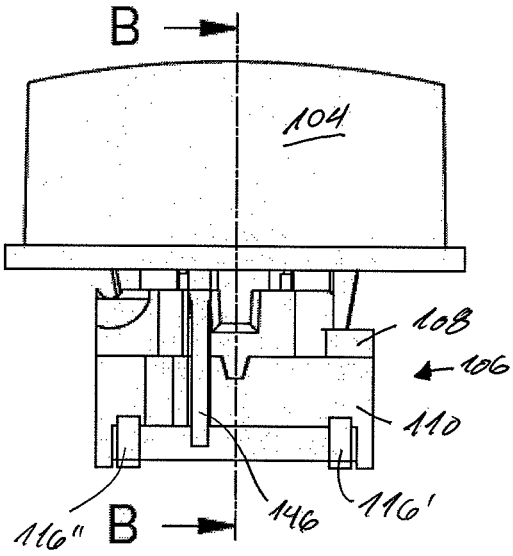
Figure 20:
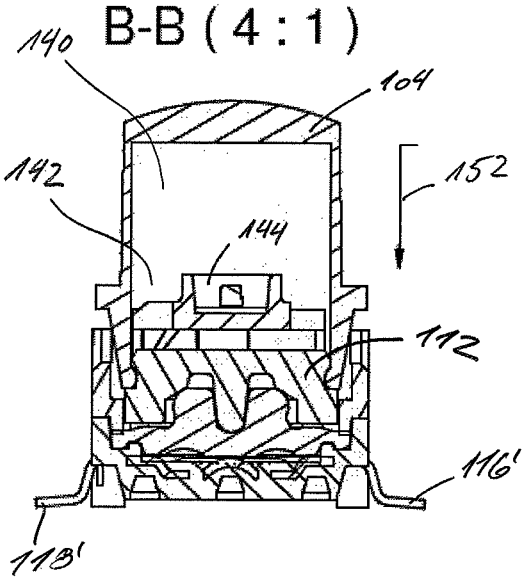

FIGS. 17 and 18 discloses the electrical switch (100) in its non-switched position and FIGS. 19 and 20 discloses the electrical switch (100) in its switched poison. Arrow 152 indicate that the activation button 104 is depressed.

It may be seen that in the non-switched position, the lower surface of the light emitting element 144 in contacting the upper surface of the activation element 112, whereas the two surfaces are spaced apart when the activation element 112 is in its switched position. Accordingly, it will be appreciated from the figures, that movement of the activation button 104 and the activation element 112 may occur while the light emitting element 144 remains in the same vertical position.

The invention claimed is:

1. An electrical switch (100) adapted to be engaged by a first and a second activation button (102,104) by means of which a user may operate the electrical switch (100), the electrical switch (100) comprising:

a housing (106);

at least one set of conductors (114',114"), each set of conductors comprising a first conductor (116',116") and a second conductor (118',118"); and an activation element (112) which is movable between:

a switched position in which the conductors (116',116", 118',118") are electrically connected, and a non-switched position in which the conductors (116', 116",118',118") are not electrically connected, wherein an outer surface (120) of the activation element (112) defines:

a set of first retaining surfaces (122) adapted to retain the first activation button (102) in relation to the activation element (112) by engagement between the set of first retaining surfaces (122) and a corresponding set of first mating surfaces (136) defined by the first activation button (102), and a set of second retaining surfaces (124) adapted to retain the second activation button (104) in relation to the activation element (112) by engagement between the set of second retaining surfaces (124) and a corresponding set of second mating surfaces (126) defined by the second activation button (104).

2. An electrical switch according to claim 1, wherein the first retaining surfaces (122) and the second retaining surfaces (124) are provided at different radial, translational or circumferential positions.

3. An electrical switch according to any of the preceding claims, wherein the first and second retaining surfaces (122, 124) are arranged such with respect to each other that the first activation button (102) cannot be retained in relation to the activation element (112) by engagement between the first mating surfaces (136) and the second retaining surfaces (124).

4. An electrical switch according to any of the preceding claims, wherein the first and second retaining surfaces (122, 124) are arranged such with respect to each other that the second activation button (104) cannot be retained in relation to the activation element (112) by engagement between the second mating surfaces (126) and the first retaining surfaces (122).

5. An electrical switch according to any of the preceding claims, wherein the first retaining surfaces (122) of the outer surface (120) define arcs of a circle having a first radius and wherein the second retaining surfaces (124) of the outer surface (120) define arcs of a circle having a second radius, and wherein the first radius is different from the second radius.

6. An electrical switch according to any of the preceding claims, wherein the activation element (112) defines radially extending protrusions (130) which defines the first retaining surfaces (122).

7. An electrical switch according to any of the preceding claims, wherein the second activation button (104) comprises translationally extending engagement members (128) each of which defines one of the second mating surfaces (126).

8. An electrical switch according to claim 7, wherein the translationally extending engagement members (128) are positioned in spaces (138) defined between the radially extending protrusions (130) when the second activation button (104) is attached to the activation element (112).

9. An electrical switch according to any of the preceding claims, wherein at least one of the first and second activation buttons (102,104) defines a cavity (140) with an opening (142) which faces the activation element (112) when the activation button (102,104) is attached to the activation element (112).

10. An electrical switch according to any of the preceding claims, comprising a light emitting element (144) arranged to emit light into that one of the activation buttons (102,104) which is attached to the activation element (112).

11. An electrical switch according to claim 10, wherein the light emitting element (144) remains in the same position relative to the housing (106) irrespective of the position of the activation element (112).

12. An electrical switch according to claim 10 or 11, wherein the light emitting element (144) is arranged such with respect to the activation button (102,104) that light may be emitted into the cavity (140) of that one of the activation buttons (102,104) which is attached to the activation element (112) while at the same time allowing said activation button (102,104) to move the activation element (112) between its switched and non-switched position.

13. An activation button (102,104) for use with the electrical switch (100) according to any of the preceding claims.

14. A combination of an activation button (102,104) according to any of the preceding claims and an electrical switch (100) according to any of claims 1-12.

15. A kit comprising an activation button (102,104) according to any of the preceding claims and an electrical switch (100) according to any of claims 1-12.

* * * * *